US009281648B2

(12) United States Patent
Pollner

(10) Patent No.: US 9,281,648 B2
(45) Date of Patent: Mar. 8, 2016

(54) BRUSH BLOCK FOR A SLIPRING

(71) Applicant: Schleifring und Apparatebau GmbH, Fürstenfeldbruck (DE)

(72) Inventor: Peter Pollner, Fürstenfeldbruck (DE)

(73) Assignee: SCHLEIFRING UND APPARATEBAU GMBH, Furstenfeldbruck (DE)

( * ) Notice: Subject to any disclaimer, the term of this patent is extended or adjusted under 35 U.S.C. 154(b) by 0 days.

(21) Appl. No.: 14/497,488

(22) Filed: Sep. 26, 2014

(65) Prior Publication Data

US 2015/0024610 A1 Jan. 22, 2015

Related U.S. Application Data

(63) Continuation of application No. PCT/EP2013/055038, filed on Mar. 12, 2013.

(30) Foreign Application Priority Data

Mar. 26, 2012 (DE) ..... 10 2012 204 830

(51) Int. Cl.

| | |
|---|---|
| ***H01R 39/08*** | (2006.01) |
| ***H01R 39/64*** | (2006.01) |
| ***H01R 35/04*** | (2006.01) |
| ***H01R 39/00*** | (2006.01) |
| ***H01R 39/26*** | (2006.01) |
| ***H01R 4/48*** | (2006.01) |
| ***H01R 39/18*** | (2006.01) |

(Continued)

(52) U.S. Cl.

CPC ..... *H01R 39/643* (2013.01); *H01R 4/48* (2013.01); *H01R 39/18* (2013.01); *H01R 39/36* (2013.01); *H01R 39/39* (2013.01); *H01R 39/64* (2013.01)

(58) Field of Classification Search

CPC ..... H01R 39/00; H01R 39/64; H01R 39/08; H01R 35/04; H01R 39/26

See application file for complete search history.

(56) References Cited

U.S. PATENT DOCUMENTS

| | | | | |
|---|---|---|---|---|
| 3,329,923 A * | 7/1967 | Davis | ..... | H01R 39/00 191/59.1 |
| 4,098,526 A * | 7/1978 | DuBois | ..... | A01K 1/126 119/14.04 |

(Continued)

FOREIGN PATENT DOCUMENTS

| | | |
|---|---|---|
| DE | 101 58 381 | 6/2003 |
| EP | 1 531 528 | 5/2005 |

(Continued)

OTHER PUBLICATIONS

International Search Report and Written Opinion in International Application No. PCT/EP2013/055038 dated Jun. 5, 2013.

(Continued)

*Primary Examiner* — Gary Paumen

(74) *Attorney, Agent, or Firm* — Norton Rose Fulbright US LLP

(57) ABSTRACT

A brush block for a slip ring assembly consists of a spring wire that is mechanically supported by two bores of a printed circuit board and continues into two contact springs. Furthermore, the spring wire comprises a solder joint for electrically contacting the printed circuit board. The solder joint is mechanically decoupled from the contact springs by means of two cranks of the spring wire.

19 Claims, 6 Drawing Sheets

(51) Int. Cl.
*H01R 39/36* (2006.01)
*H01R 39/39* (2006.01)

(56) References Cited

U.S. PATENT DOCUMENTS 4,323,292 A * 4/1982 Lewis ..... H01R 39/64 439/271
4,398,113 A * 8/1983 Lewis ..... H01R 39/18 310/232
4,415,635 A * 11/1983 Wilsdorf ..... H01R 39/24 310/248
4,447,752 A * 5/1984 Boyce ..... H01R 39/24 310/232
4,544,215 A * 10/1985 Fritsch ..... H01R 39/38 310/239
5,124,606 A * 6/1992 Eisenbeis ..... H02K 17/30 112/277
5,124,608 A * 6/1992 Lawrence ..... H01R 39/64 310/143
5,865,629 A * 2/1999 Bernardini ..... H01R 39/64 439/26
6,356,002 B1 * 3/2002 Witherspoon ..... H01R 43/10 310/232
6,517,357 B1 * 2/2003 Athanasiou ..... H01R 39/64 439/26
7,001,184 B2 * 2/2006 Abouchar ..... H01R 39/24 439/13
7,774,935 B2 * 8/2010 Barbet ..... H01R 39/39 29/854
8,167,623 B2 * 5/2012 Schlichtherle ..... H01R 39/64 310/232
2005/0230098 A1 * 10/2005 Sand ..... E21B 7/068 166/65.1
2007/0167032 A1 * 7/2007 Angerpointner ..... H01R 39/24 439/22
2014/0045348 A1 * 2/2014 Lewis ..... H01R 39/24 439/18
2014/0084523 A1 * 3/2014 Herbst ..... C21D 9/562 266/103
2014/0111040 A1 * 4/2014 Badafem ..... H02K 5/148 310/51

FOREIGN PATENT DOCUMENTS

EP 1 610 425 12/2005
JP 2010 232 139 10/2010

OTHER PUBLICATIONS

International Preliminary Report on Patentability in International Application No. PCT/EP2013/055038 dated Oct. 1, 2014.

* cited by examiner

BRUSH BLOCK FOR A SLIPRING

PRIORITY CLAIM

This application is a continuation of pending International Application No. PCT/EP2013/055038 filed on 12 Mar. 2013, which designates the United States and claims priority from German Application No. 10 2012 204 830.8 filed on 26 Mar. 2012, both of which are incorporated by reference in their entireties.

BACKGROUND OF THE INVENTION

1. Field of the Invention

The invention relates to a brush block as well as to a slip ring assembly for transmission of electrical signals by means of sliding contacts between mutually rotatable parts. At least one sliding contact which is made of an electrically conductive material and is also known as the brush, slides on a slideway which is also made of an electrically conductive material. Electric current is transmitted by galvanic contact between the slideways and the contact.

2. Description of Relevant Art

A brush block, in which spring wires are soldered in a printed circuit board, is known for example from DE 201 15 215 U1 or also known from U.S. Pat. No. 4,583,797. The manufacture is relatively simple, whereby a precise positioning of the individual brush wires is hardly possible. Furthermore, the durability is not satisfactory for continuous use, since the solder joints break over time.

In EP 1453155 A2 a slip ring brush is disclosed which is soldered on the top of a printed circuit board. By flowing of solder from the underside of the printed circuit board, it is attempted to obtain a large-area solder joint which then should achieve a sufficient mechanical strength. A disadvantage of this brush block is that, besides the complex manufacturing, only a U-shaped brush assembly can be realized due to the large contact length of the brush wire on the printed circuit board, and in order avoid lateral forces on the solder joint. Thus, two brushes abut at opposite positions of the slideway, which requires much assembly space and allows only two brushes per slideway. DE 101 58 381 B4 discloses a slip ring transmitter, wherein a contact spring is fastened on a printed circuit board by a clamping mechanism. In JP 2010-232139A a generic assembly is disclosed, wherein the brush wires are soldered in through-holes.

SUMMARY OF THE INVENTION

The embodiments are based on the object of forming a brush block and a slip ring assembly such that it also allows a long-term stable fixation of the brushes and a reliable contacting. At the same time, this brush block and this slip ring assembly should be simple and inexpensive to manufacture, and have a high service life and reliability. Furthermore, a flexible brush assembly and in particular a space-saving V-shaped brush assembly should be possible, in which also a plurality of brush blocks can be attached to a slip ring.

In an embodiment, a brush block for a slideway comprises at least a carrier, which preferably is a printed circuit board. Furthermore, the brush block comprises at least one spring wire which is electrically contacted to and mechanically fixed to the carrier. The spring wire preferably is made of a metal wire or a metallic sheet. Long-term studies of brush blocks have shown that solder joints which are used both for contacting and for mechanical fixation of brushes, often fail prematurely. Therefore, the inventive brush block is based on a functional separation of electrical contacting and mechanical fixation.

The carrier preferably comprises two preferably substantially parallel bores which hold a cranked spring wire. Thereby, the cranked part of the spring wire is located on the first side of the carrier, whereas the spring wire forms at least one contact spring, preferably two contact springs on the second side of the carrier which is directed towards the slideway and/or the slip ring module. The spring wire is electrically contacted on the first side. To this end, it is soldered with an electrical conductor, such as conductor path, to the carrier. On the second side of the carrier, there is no solder connection with the spring wire. By this arrangement, an electrical contacting is effected preferably on the first side of the carrier by means of a contacting point, which preferably is a solder point. Alternatively, the contacting point may also comprise a press-fit contact. Forces which are generated by a slideway to the contact springs are introduced into the carrier via the bores starting from the second side of the carrier. Furthermore, between the contact spring and the contacting point, on the first side of the carrier, there is located a cranking for mechanical relief of the contacting solder joint. Here, the cranking is a resilient element. Thus, the pressure forces of the contact spring do not cause mechanical stress to the solder joint, which leads to a significant prolongation of service life and a significantly higher reliability. Because the spring wire is supported in two holes, there results also an anti-rotation lock, which allows the absorption of torque forces parallel to the surface of the carrier, without stressing the solder joint. The contacting point and in particular the contacting solder joint could also be through-plating in a bore, except a segment of the spring wire with a contact spring leads through said bore. Furthermore it is preferred, if the bore has a diameter corresponding to the diameter of the spring wire. To allow a good lateral guiding of the spring wire, the diameter of the bore should not be larger than twice the diameter, preferably 1.5 times and more preferably 1.2 or 1.1, respectively, 1.05 or 1.01-times the diameter. In order to achieve an even better guidance or fixation, the spring wire could be pressed into the bore. To this end, the bore preferably has a smaller diameter than the diameter of the spring wire. Preferably in this case, the diameter of the bore is not more than 0.95- or 0.9-times, and particularly preferred 0.8-times the diameter of the spring wire. In order to increase the stability of the bore, it could be provided with a through-plating. In this case, the through-plating preferably has mechanically supporting properties and strengthens the bore. Although it serves for improving the electrical contact with the carrier, the electrical contact is primarily done by the mechanically unloaded solder joint. In the case of a spring wire made of a sheet material, there could be provided a recess with a cross-section corresponding to the cross-section of the sheet material, instead of a bore.

In a further embodiment, the spring wire comprises a center portion having two ends, wherein at each end, a crank with adjoining contact spring is provided.

In a further embodiment, a crank with an adjoining contact spring is provided only at one end of the center portion.

Alternatively, instead of one crank, also two or more cranks can be provided one behind another. Basically, a crank may have different shapes. It could be semi-circular or rectangular, or could also have a polygonal wire guide.

Particularly preferred is an arrangement of the contact spring in a V-shape, since this is particularly compact and has good transmission characteristics. However, each other respective form, particularly a U-shape is producible, in which the contact springs protrude approximately perpendicularly from the bores of the carrier. Preferably, the spring wire is not soldered inside the bores. Particularly preferred, the bores are not metalized on the inside. However, good results may also be achieved with spring wires which are soldered in the holes. Thus, the solder joint in the bore is not primarily necessary for the electrical contact, because the electrical contact is effected via a contacting point that is mechanically decoupled by means of a crank. Thus, such a brush block would work perfectly even in case of failure of the solder joint in the bore.

The brushes are preferably metal wires, and comprise at least one electrically conductive material. Preferably, they have a core of a mechanically stable and resilient material, such as steel, copper-beryllium, or brass, as well as an outer coating or cover made of an electrically highly conductive and preferably corrosion-resistive material, such as silver, gold, or a gold alloy. Similarly, the brushes my also comprise wires of silver and/or gold and/or alloys thereof.

An inventive slip ring assembly comprises a slideway as well as at least one of the disclosed brush blocks. For guidance of the brushes, the slideway preferably has at least one V-groove. Basically, however, also slideways with different geometries can be used. This may be, for example, planar slideways or slideways with U-shaped grooves (semi-circular, elliptical).

An inventive method for manufacturing of a brush block as described herein comprises the following steps:

1. Providing a carrier with at least two bores,
2. Inserting a spring wire having at least one crank,
3. Producing a contacting solder joint.

Optionally, a lateral bending of the contact spring can be effected to adjust the correct angle and the correct shape respectively, such as for example a V-shape.

BRIEF DESCRIPTION OF THE DRAWINGS

In the following, the invention will be described by way of example, without limitation of the general inventive concept, on examples of embodiment and with reference to the drawings.

DETAILED DESCRIPTION OF THE PREFERRED EMBODIMENTS

Figure 1:
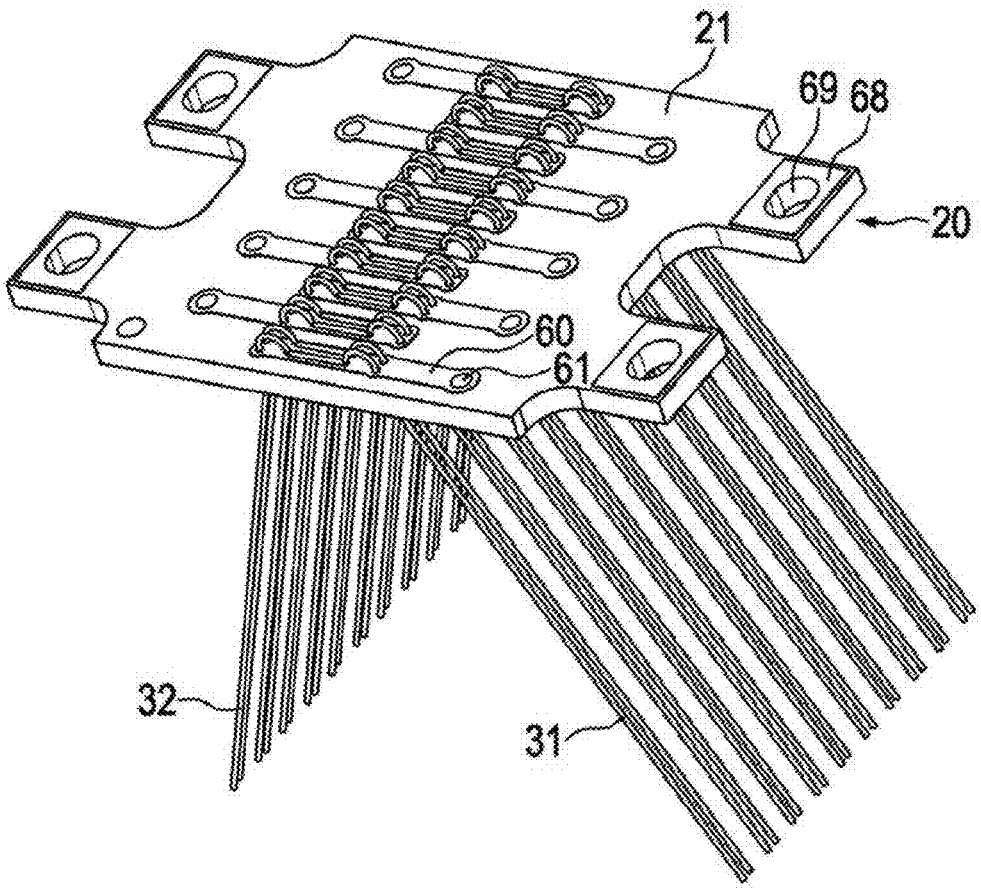
FIG. 1 shows an inventive brush block.

In FIG. 1, a first embodiment of a brush block 20 is shown. The brush block has a carrier 21, preferably a printed circuit board. The carrier 21 serves for receiving the contact springs 31, 32 as well as conductor paths 60 for the connection of the contact springs. Here, the contact springs protrude in a V-shape from the carrier. By this design, at least two, but usually also four brush blocks can be arranged around a slip ring module, which allows a higher number of contacts. Here, the conductor paths comprise connection bores 61, into which or through which, respectively, a connection wire can be inserted and soldered. Here, exemplarily two pairs of contact springs are connected electrically by means of conductor paths. By means of these parallel circuits, the contact resistance can be reduced, the reliability can be increased, and the contact noise can be reduced. The fastening of the brush block can be effected via the fastening elements 68 with bores 69.

Figure 2:
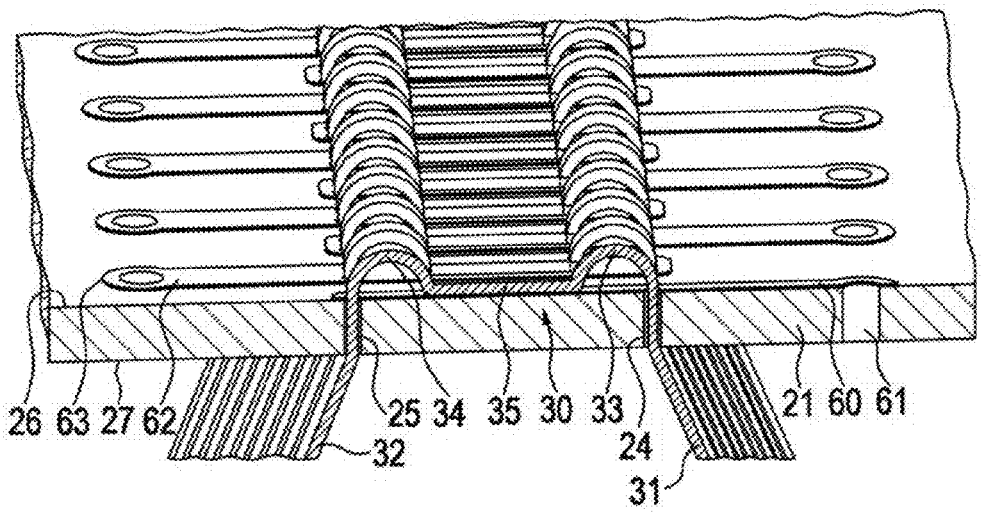
FIG. 2 shows the sectional view of a brush block.

In FIG. 2, a brush block is shown in a sectional view. The first contact spring 31 and the second contact spring 32 are formed integrally of one spring wire. The spring wire has a center portion 35 which is soldered to the carrier 21 in a contacting point. Thereby, it is preferably soldered to a conductor path 60. The middle portion 35 merges on one side into a first crank 33 and from there into the first contact spring 31, as well as from the second side into a second crank 34, and from there into the second contact spring 32. The center portion 35 and the cranks 33, 34 are located on the first side 26 of the carrier. The contact springs 31, 32 are guided through the carrier 21 via bores 24, 25 to the second side 27. The bores of the carrier 21 may optionally be metalized or not metalized on the inside. It is preferred, if the contact springs in the bores are not soldered with the printed circuit board. Therefore, it is further preferred if the bores are not metalized.

Figure 3:
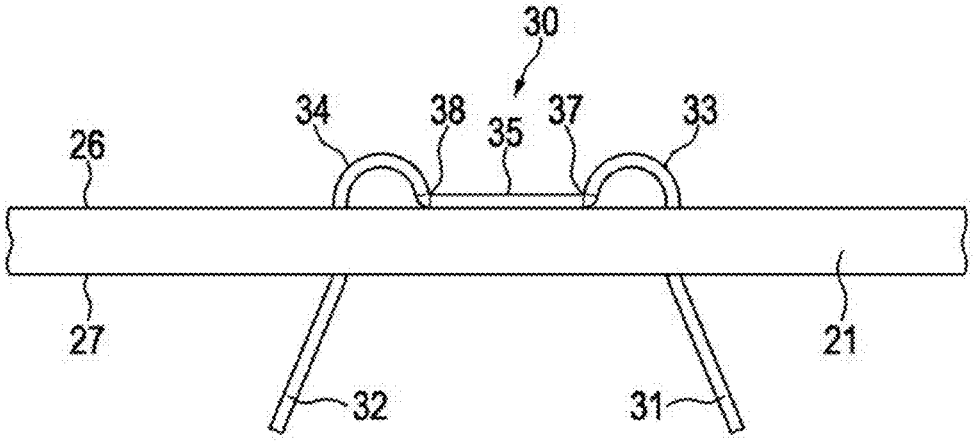
FIG. 3 shows a further sectional view of a brush block.

In FIG. 3, the brush block is once again shown in a sectional view. Here, the spring wire 30 with the center portion 35, with its ends 37, 38, the cranks 34, 33 as well as the contact springs 31, 32 can be seen.

Figure 4:
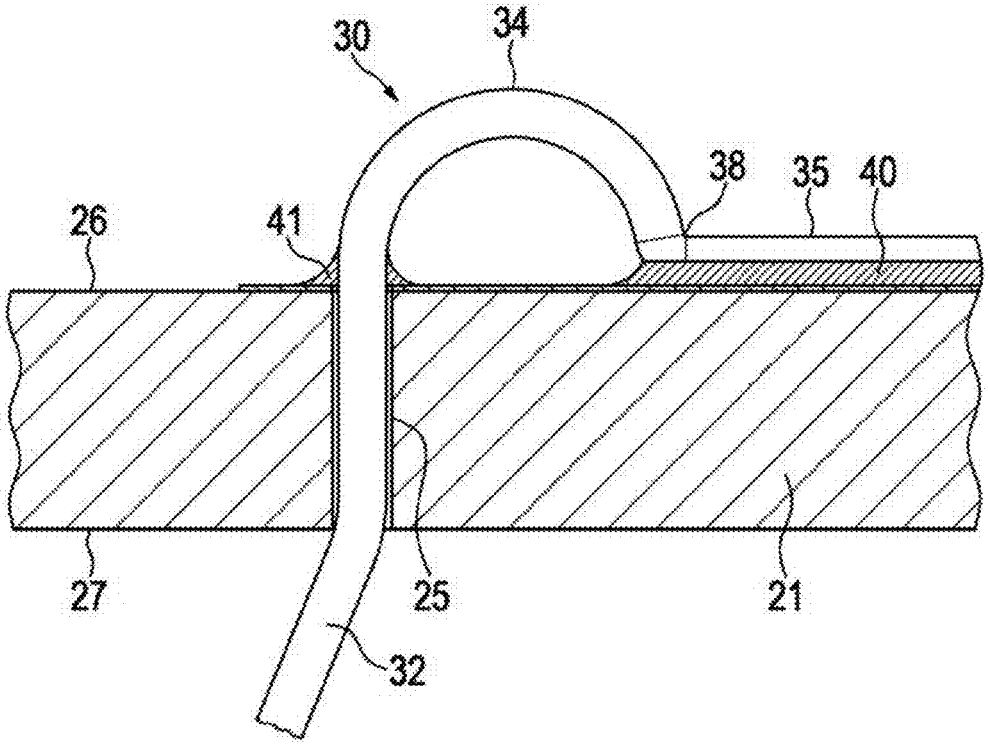
FIG. 4 shows a detail of the spring wire.

In FIG. 4, a detail of a spring wire is shown. The center portion 35 of the spring wire 30 is connected with the first side 26 of the carrier 21 by means of the contacting point 40. A further solder joint 41 may be disposed between the second crank 34 and the second contact spring 32 at the first side 26 of the carrier 21, for the mechanically discharging the contacting point 40 via the crank 34. Preferably, there is no solder material at this position. Furthermore preferred, there is no solder joint between the second contact spring 32 and the second bore 25 in the carrier 21. However, there could exist, for example, a press-fitting or a form-fitting between these.

Figure 5:
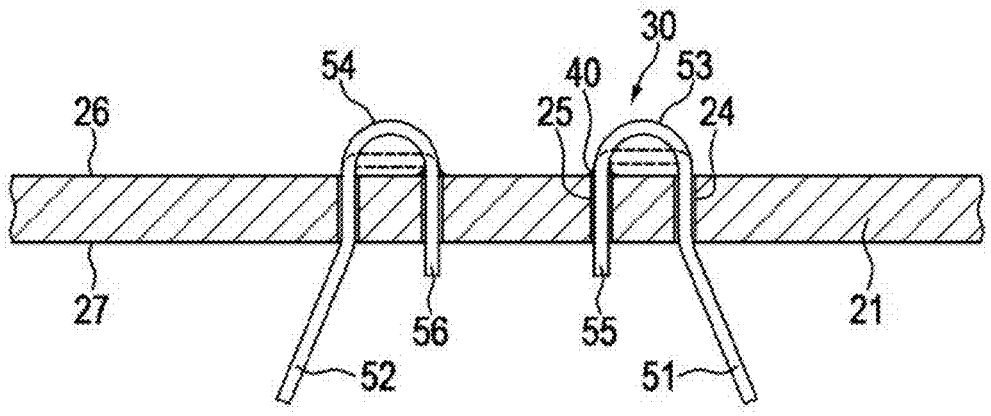
FIG. 5 shows another embodiment.

In the FIG. 5, another embodiment is shown. Here, the first contact spring 51 and the second contact spring 52 are separate mechanical components. They are not connected to one another by a center portion. Instead, a first end piece 55 at one end of the crank 53 is guided through a second bore 25, and a first contact spring 51 is guided through a first bore 24. The second contact spring is formed preferably symmetrically thereto. A second end piece 56 at the other end of the crank 54 to the second contact spring 52 is fixed through a bore in the carrier 21. The contact springs as shown herein can be used singularly or optionally arranged symmetrically. The contacting point 40 is located on the first side of the carrier 21 at the end of the second bore 25, or in a through-plating of this bore.

Figure 6:
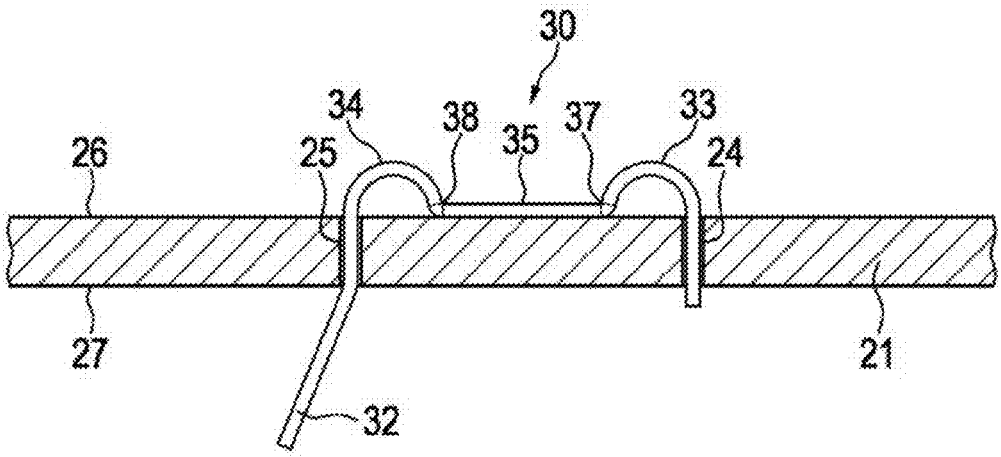
FIG. 6 shows a further embodiment.

In FIG. 6, a further embodiment is shown. This is similar to the embodiment of FIG. 3. However, only one contact spring 32 is provided.

Figure 7:
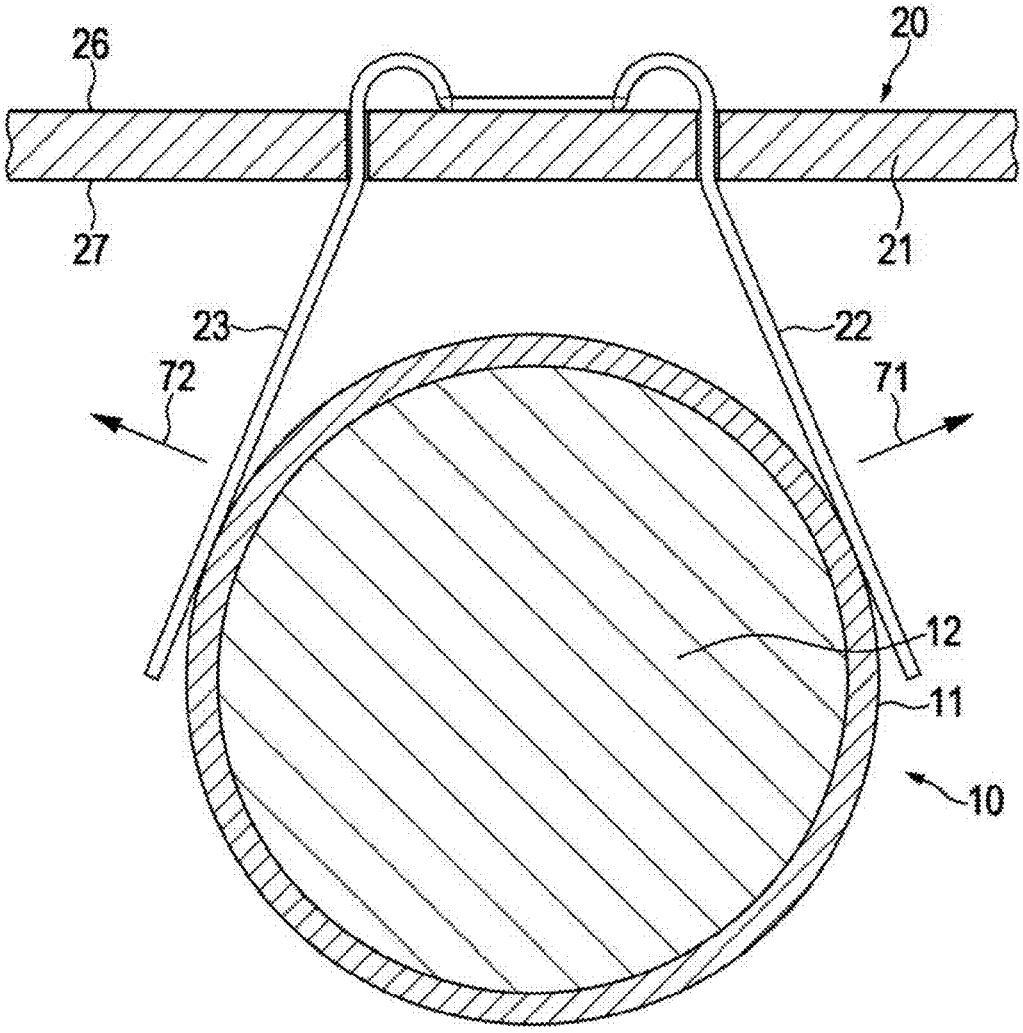
FIG. 7 shows a complete slip ring transmission.

In FIG. 7, a complete slip ring transmission with a brush block 20 is shown, the first contact spring 22 and second contact spring 23 of which slide on a slideway 11 on a slideway carrier 12 of a rotatable slip ring module 10, and thus are in electrical contact with this slip ring module. Here additionally, the directions of the forces 71, 72 on the contact spring 22, 23 are illustrated.

Figure 8:
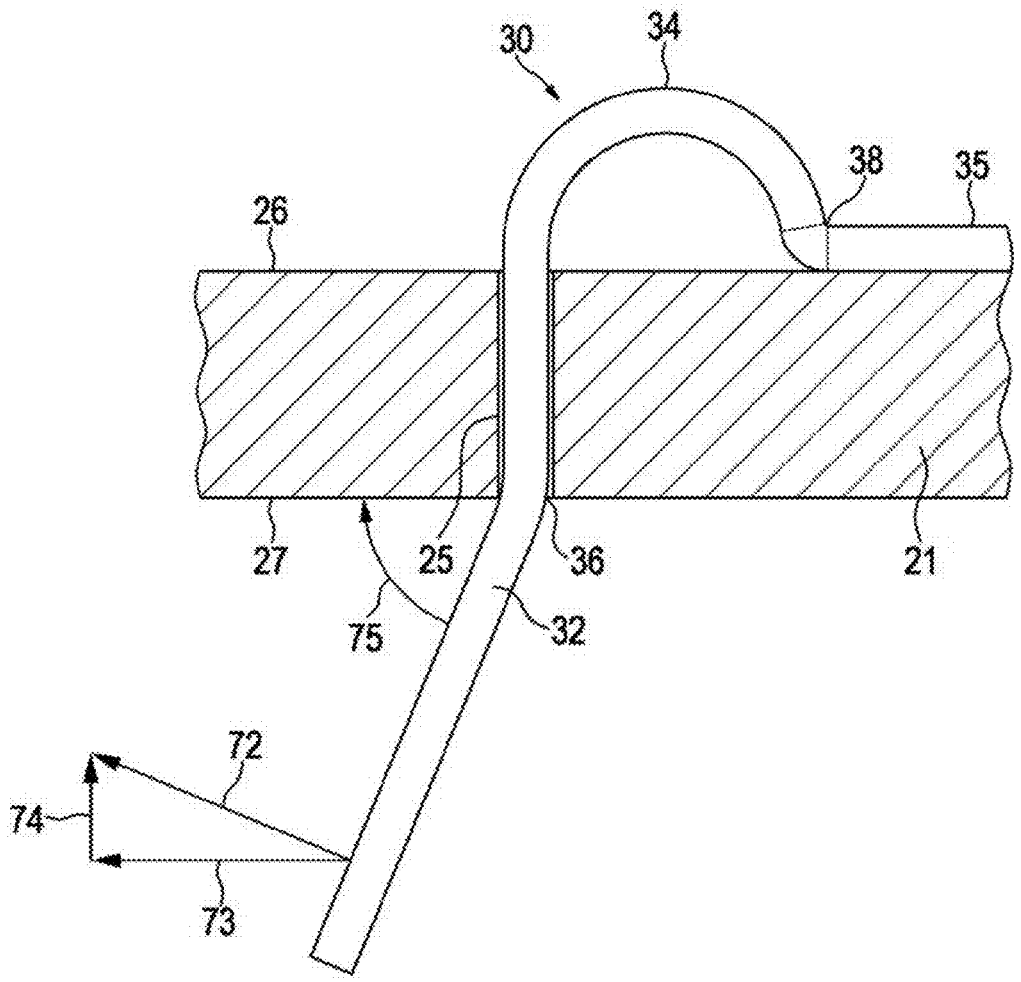
FIG. 8 shows the forces at contact springs.

In FIG. 8, once more the forces on the contact spring are illustrated in detail. The forces 71, 72 are perpendicular to the bearing points of the contact springs on the slideway. In this illustration, only the force 72 is dealt with, as the force 71 on the opposite contact spring is symmetrical thereto. The force 72 may be separated into a first component 73 parallel to the carrier and a second component 74 perpendicular to the carrier. The component 73 parallel to the carrier is balanced by a second, opposed component of the other contact spring. The component 74 perpendicular to the carrier is already partially received at the bending point 36 of the contact spring directly at the beginning of the bore 25 in the carrier. The crank 34 acts as a spring and prevents that a still small portion of the second perpendicular component 74 stresses the solder joint at the center portion too heavily. Furthermore, a bending moment 75 results from these forces at the entry point of the contact springs into the carrier 21, which may be largely absorbed by the bore 25 in the carrier.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

It will be appreciated to those skilled in the art having the benefit of this disclosure that this invention is believed to provide sliprings and brushes thereof. Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

LIST OF REFERENCE NUMERALS

10 slip ring module
11 slideway
12 slideway carrier
20 brush block
21 carrier
22 first contact spring
23 second contact spring
24 first bore
25 second bore
26 first side of the carrier
27 second side of the carrier
30 spring wire
31 first contact spring
32 second contact spring
33 first crank
34 second crank
35 center portion
36 bending point
37, 38 ends of the center portion
40 contacting point
41 solder joint contact spring
51 first contact spring
52 second contact spring
53 first crank
54 second crank
55 first end piece
56 second end piece
60, 62 conductor path
61, 63 connection bore
68 fastening element
69 fastening bore
71, 72 forces on the contact springs
74 force components

The invention claimed is:

1. Brush block for at least one slideway, the brush block comprising:

a carrier with a first side configured to face away from the slideway, and a second side configured to face toward the slideway, and a spring wire fastened to the carrier, the spring wire defining one or more contact springs, wherein the spring wire is electrically connected by a contacting point with an electrical conductor at the carrier, wherein the carrier comprises two bores for supporting the spring wire, and the spring wire extends through both bores from the first side to the second side, and extends from at least one of the two bores to define the one or more contact springs on the second side, and wherein the spring wire defines on the first side of the carrier one or more relief members each disposed between the contacting point and one of the one or more contact springs, wherein each relief member comprises a portion of the guide wire that is spaced apart from the first side of the carrier between the contacting point and the contact spring.

2. Brush block according to claim 1, wherein each relief member is configured to reduce the ability of the guide wire to transmit force from the contact spring to the contacting point.

3. Brush block according to claim 1, wherein the relief member comprises an arc defined by the guidewire.

4. Brush block according to claim 1, wherein the contacting point comprises a solder joint.

5. Brush block according to claim 1, wherein the contacting point comprises a press-fitting contact.

6. Brush block according to claim 1, wherein the spring wire comprises a center portion with two ends, the center portion continues at each end in a relief member with an adjoining contact spring, and the center portion is connected to the carrier via a contacting point.

7. Brush block according to claim 1, wherein the spring wire comprises a center portion with two ends, the center portion has a relief member at each end, only one of the two relief members merges into an adjoining contact spring, the second relief member protrudes with one end in a bore, and the center portion is connected to the carrier via the contacting point.

8. Brush block according to claim 1, wherein the spring wire comprises a relief member with a contact spring adjoining at one side and extending through the first bore, and the second side of the relief member extends into the second bore and is connected to the carrier via the contacting point.

9. Brush block according to claim 1, wherein the second bore is metallized on the inside and filled with solder.

10. Brush block according to claim 1, wherein the carrier comprises a printed circuit board.

11. Brush block according to claim 1, wherein each contact spring comprises a core of a mechanically stable and resilient material, as well as an outer coating or cover made of an electrically highly conductive material.

12. Brush block according to claim 9, wherein the mechanically stable and resilient material comprises steel, copper-beryllium or brass.

13. Brush block according to claim 9, where in the electrically highly conductive material is also corrosion resistant.

14. Brush block according to claim 11, wherein the electrically highly conductive and corrosion-resistant material comprises silver, gold, or a silver or gold alloy.

15. Brush block according to claim 1, wherein each contact spring comprises at least one of silver, gold and a silver or gold alloy.

16. Brush block according to claim 1, wherein at least one contact spring is provided on the first side of the carrier.

17. Brush block according to claim 1, wherein at least one of the two bores, through which a contact spring of the spring wire extends, comprises a metallization on the inside that is not soldered to the spring wire.

18. Slip ring assembly comprising a slideway and at least one brush block according to claim 1.

19. Method for manufacturing a brush block according to claim 1, comprising the following steps:

providing a carrier with at least two bores inserting a spring wire through two of the at least two bores, the spring wire having at least one relief member producing a contacting solder joint.

* * * * *